United States Patent [19]

High et al.

[11] 3,960,257

[45] June 1, 1976

[54] APPARATUS FOR CONVEYING AND ENGRAVING TOKENS

[75] Inventors: Cliff R. High; Morley Brotman, both of Tacoma, Wash.

[73] Assignee: Morley Studios, Tacoma, Wash.

[22] Filed: Apr. 26, 1974

[21] Appl. No.: 464,649

[52] U.S. Cl. ..... 197/6.7; 101/4; 198/25; 198/209; 214/1 BC; 214/8.5 H

[51] Int. Cl.[2] ..... B41J 1/30; B41F 17/36

[58] Field of Search ..... 197/6.7, 6.6, 6.4, 6.5, 197/46, 47; 101/4, 11, 10, 9, 35, 43, 44; 214/8.5 H, 1 BC; 198/209, 25, 19

[56] References Cited

UNITED STATES PATENTS

| | | | |
|---|---|---|---|
| 402,467 | 4/1889 | McIndoe | 101/11 X |
| 1,144,340 | 6/1915 | Campbell | 101/4 UX |
| 2,265,813 | 12/1941 | Peters | 197/6.7 |
| 2,438,271 | 3/1948 | Curtis | 197/6.6 |
| 3,047,124 | 7/1962 | Wexler | 198/209 X |
| 3,416,440 | 12/1968 | Miller et al. | 101/35 |
| 3,543,679 | 12/1970 | Wahl | 101/35 |
| 3,630,334 | 12/1971 | Connolly et al. | 197/6.7 |
| 3,643,771 | 2/1972 | Takebe | 197/6.7 |

*Primary Examiner*—Clifford D. Crowder
*Attorney, Agent, or Firm*—Christensen, O'Connor, Garrison & Havelka

[57] ABSTRACT

A token engraving apparatus comprising a turret movable through a path of travel between a blank token receiving station, an engraving station and an ejection station. Gravity causes blank tokens to fall from a plurality of tubular blank token holders into apertures, formed in the turret, at the blank token receiving station. The turret moves the blank tokens to the engraving station. A type head comprising a plurality of radially extending type bars moves independently of the movement of the turret so as to sequentially position the type of desired type bars above the token located at the engraving station. Located at the engraving station, above the tokens and the type ends of the type bars, is an electromechanical press. When energized the press moves the particular type bar located above the token downwardly against the upper peripheral edge of the token causing a character to be engraved therein. A type head locking mechanism locks the type head in position during engraving. In addition, subsequent to engraving a token indexing mechanism rotates the token at the engraving station a predetermined angular distance whereby it is ready for the next character to be engraved therein. Subsequent to engraving the last desired character, the turret moves the engraved token to the ejection station. At the same time, a new blank token is moved by the turret to the engraving station.

17 Claims, 5 Drawing Figures

Fig. 1.
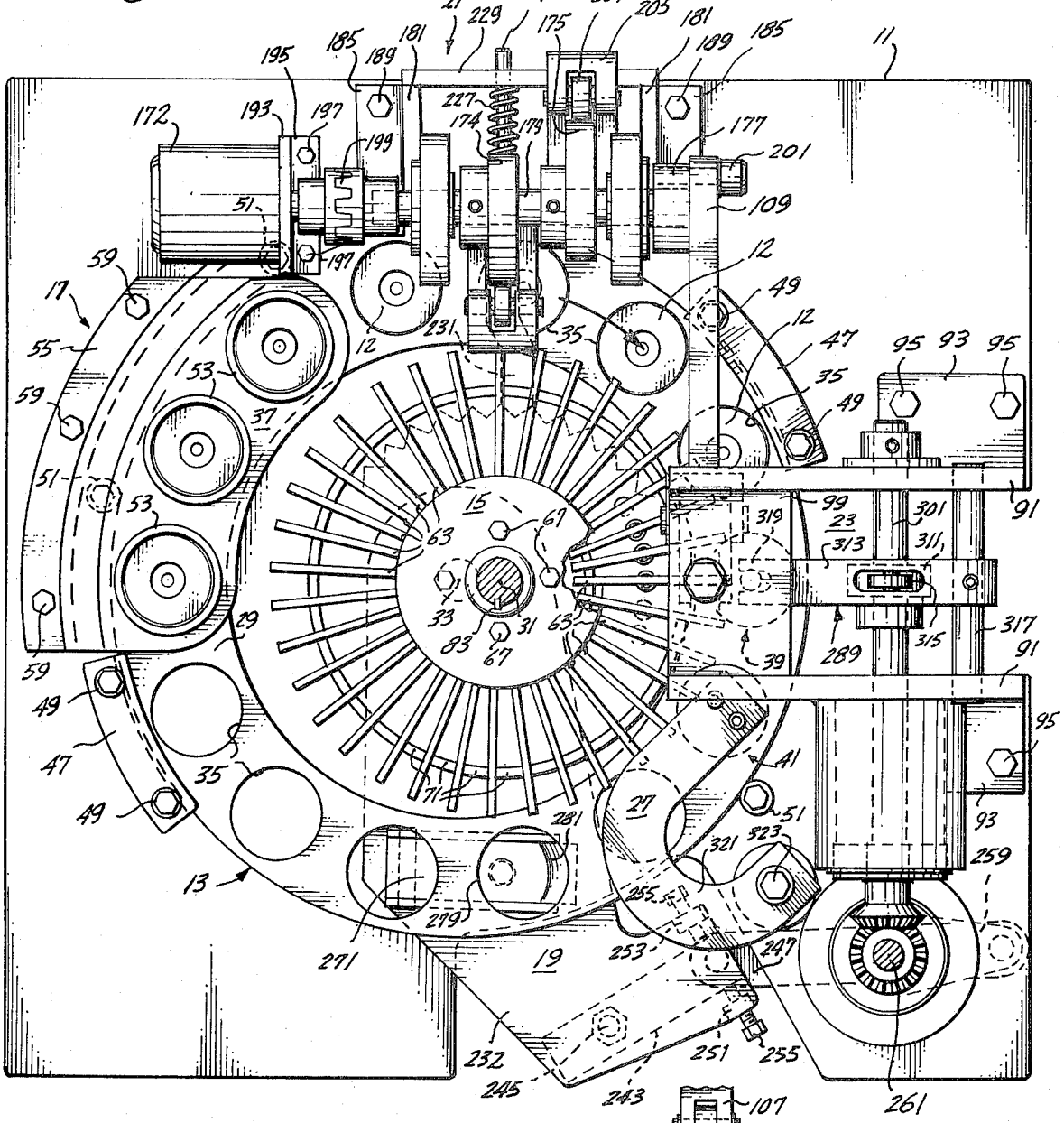
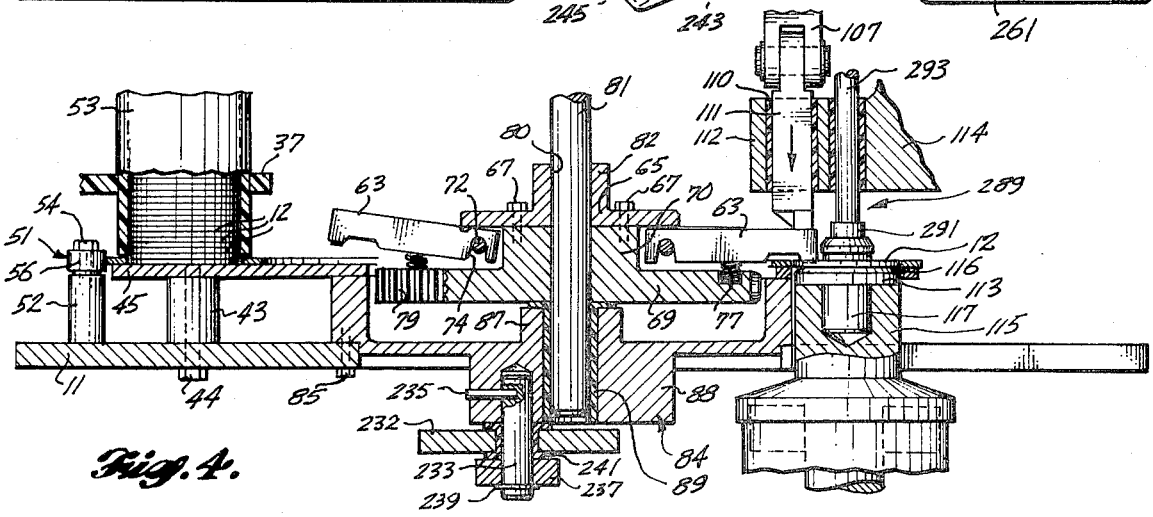
Fig. 4.

APPARATUS FOR CONVEYING AND ENGRAVING TOKENS

BACKGROUND OF THE INVENTION

This invention is directed to token engraving apparatus, and more particularly, to token engraving apparatus suitable for engraving selected characters into one surface of a blank token.

As used herein the term engraving is generic to the creation of characters in tokens by either depressing the character into the token or by depressing the material surrounding the character so as to effectively "raise" the character. The latter technique is sometimes referred to as embossing. Thus, as will be better understood from the following description of the invention, while the mechanism of the invention preferably creates depressed characters because the pressure to be applied is less than that needed to create raised characters (and the image is usually clearer) it is to be understood that the mechanism can also be used to create raised (embossed) characters, if desired.

Various types of token engraving apparatus suitable for engraving characters into tokens have been proposed, and some are in use. For a variety of reasons, these prior art token engraving apparatus have not proven to be entirely satisfactory. In general, prior art token engraving apparatus have not proven to be satisfactory because they have failed to produce tokens which have characters clearly imprinted thereon in an exact geometrical configuration. In other words, prior art token engraving apparatus have failed to create clear, distinguishable and exactly oriented characters on the tokens produced by such apparatus. One reason why prior art apparatus of this nature has failed in this regard relates to their various modes of operation. More specifically, in general, prior art token engraving apparatus are complicated, manually operated mechanisms. Because they are entirely mechanical and manually operated, the force necessary to create engraved characters has generally been unequally applied for each character. Thus, the resultant characters have been uneven in depth, even if clear. Further, the mechanical mechanisms used to position the characters have been unsatisfactory whereby the characters are unequally spaced, again even if clear. In addition, some prior art token engraving apparatus have allowed the tokens to move slightly during engraving whereby the characters have been blurred.

In addition to the problems of the prior art related to clarity and symmetry of character engraving, there are two broad mechanical areas where the operation of prior art apparatus has been especially unsatisfactory. The first area relates to the mechanism for moving the tokens to be engraved and the second relates to the lack of adjustment throughout the overall apparatus. The major problem with the token moving mechanism of prior art token engraving apparatus relates to the frequency of jamming. More specifically, many prior art token moving mechanisms have a propensity to jam frequently. Each time they jam, they must be serviced and cannot be used. Thus, if they are "coin operated" token engraving apparatus, the customers thereof become frustrated and the owners lose income.

The second major problem, lack of adjustment, requires that the elements of the prior art token engraving apparatus be accurately formed, usually by machining, because if the elements are not accurately formed, they will not co-act in the desired manner. Another problem related to this major area is element wear. Specifically, because of the prior art's inability to be adjusted, element wear requires element replacement. Thus, lack of an adjustment capability makes the prior art apparatus both expensive to produce and expensive to maintain. A related disadvantage is the inability to adjust the machine for variations in token thickness which results in jamming and its attendant disadvantages, discussed above.

Therefore, it is an object of this invention to provide a new and improved token engraving apparatus.

It is a further object of this invention to provide a token engraving apparatus wherein tokens are accurately indexed so that characters engraved therein are equally spaced.

It is yet another object of this invention to provide a token engraving apparatus which includes mechanism for applying equal force during each engraving operation so that each character is engraved to the same depth.

It is a still further object of this invention to provide a new and improved token engraving apparatus that is relatively uncomplicated, yet accurately and clearly engraves characters into one surface of a token without requiring the application of manual force to perform the engraving operation.

It is also an object of this invention to provide a token engraving apparatus that includes a token moving mechanism that is essentially jam proof.

It is still another object of this invention to provide a token engraving apparatus that is easily, accurately adjusted.

SUMMARY OF THE INVENTION

In accordance with principles of this invention, a token engraving apparatus comprising a turret containing a plurality of apertures suitable for holding tokens and moving them between a receiving station, an engraving station and an ejection station is disclosed. Located above the turret at the receiving station is a token supply mechanism adapted to drop blank tokens into the apertures in the turret as they pass beneath the token holders. A print mechanism moves character type, in a selectable manner, to a position above tokens moved to the engraving station. A press creates a downward force which forces the thusly positioned character type into the token located at the engraving station and thereby engraves a character into the surface of the token. Thereafter the token is indexed a character position and the engraving cycle is repeated for the next character. Subsequent to engraving a desired set of characters, the turret moves the engraved token to the ejection station whereat it is ejected.

In accordance with other principles of this invention, the print mechanism comprises a print head including a plurality of radial type bars extending outwardly from a central support. Type suitable for engraving a character into a token is located on the lower outer tip of each type bar. The print head is rotated so as to bring a desired character type to a position above the token at the engraving station and a locking mechanism locks the print head in a registration position with respect to the token during the engraving operation.

In accordance with further principles of this invention, the characters are engraved about the periphery of one surface of the tokens and the tokens are indexed a predetermined angular amount after each engraving operation by an indexing mechanism.

In accordance with still further principles of this invention, the print head locking mechanism, the token indexing mechanism and the press are all coupled together and operated by a common single revolution electric motor. Because all of these mechanisms are coupled together each sequence of operation occurs in the same manner each time the common electrical motor is started and rotates its shaft through 360°.

In addition, in accordance with additional principles of this invention, a turret indexing mechanism is provided for indexing (moving) the turret an arcuate amount each time it is operated. Further, a token hold down mechanism is provided for pressing tokens located at the engraving station against an anvil (forming part of the token indexing mechanism) during engraving; the token hold down mechanism being released when the turret is indexed from one position to the next position. Moreover, the turret indexing mechanism and the token hold down mechanism are operated by a second single revolution electric motor.

In accordance with yet further principles of this invention, the turret is circular and rotates about an axis that is non-coaxial with the axis of rotation of the print head.

It will be appreciated from the foregoing brief summary that the invention provides a token engraving apparatus which overcomes many of the prior art disadvantages noted above. Specifically, because the token engraving apparatus utilizes electromechanical mechanisms, equal amounts of pressure are applied each time a character is to be engraved. Further, the electromechanical mechanisms allow the tokens to be indexed an equal arcuate amount subsequent to each engraving action whereby characters are equally spaced. In addition, because the type head locking mechanism, token indexing mechanism and press are coupled together, the same operations occur in the same sequence each time an engraving operation occurs. Because the sequence is the same each time, the alignment and other difficulties of prior art apparatus are eliminated. Moreover, tokens are accurately and rapidly moved in a jam proof manner. Finally, the apparatus can be readily constructed in a manner such that it can be easily and accurately adjusted.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is a plan view of a preferred embodiment of the invention;

FIG. 4 is a cross-sectional view along line 4-4 of FIG. 1; and,

DESCRIPTION OF THE PREFERRED EMBODIMENT

Figure 2:
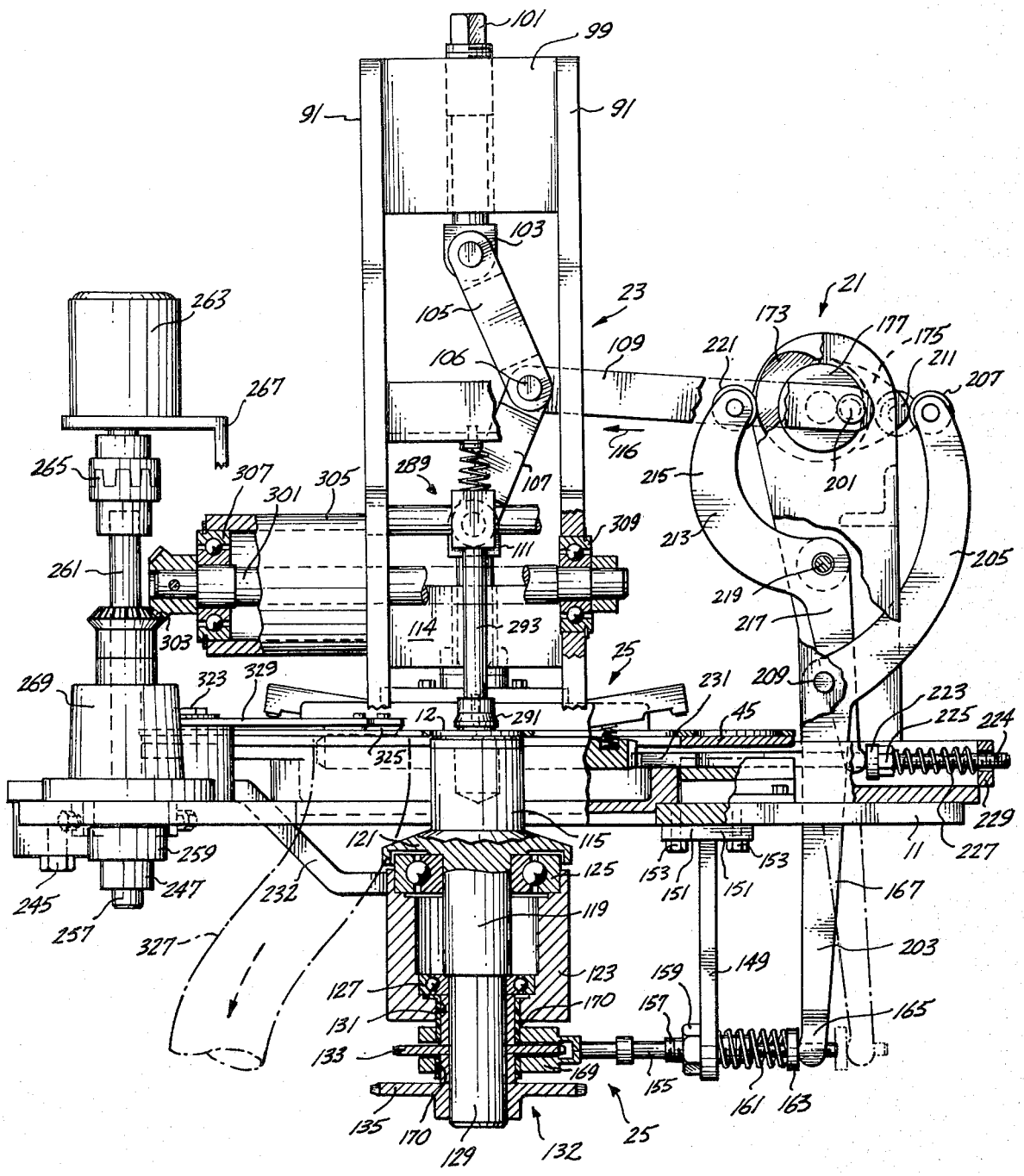
FIG. 2 is a side view of the embodiment of the invention illustrated in FIG. 1.

The drawings illustrate a preferred embodiment of the invention which comprises a horizontal mounting plate 11 that supports a turret mechanism 13; a print mechanism 15; a token supply mechanism 17; a turret indexing mechanism 19; an engraving control mechanism 21; a press 23; a token indexing mechanism 25; and, an ejection mechanism 27. In general, the turret mechanism includes a flat ring-shaped turret 29 supported near the center of the mounting plate 11 in the manner hereinafter described. Located near the center of the turret 29 is the print mechanism 15. Located about the turret, starting at the top of FIG. 1 are: the engraving control mechanism 21; the press 23; the ejection mechanism 27; the turret indexing mechanism 19; and, the token supply mechanism 17. By definition, the token supply mechanism is located at a token supply station 37; the press is located at an engraving station 39; and, the ejection mechanism is located at an ejection station 41. The turret 29 carries tokens from the supply station to the engraving station and, then, to the ejection station.

GENERAL OPERATIVE DESCRIPTION

The tokens 12 are flat cylindrical items formed of a suitable material, such as anodized aluminum, and may have a suitable design, such as a figure of a historic monument, engraved on one or both surfaces prior to being character engraved by the invention. Such blank tokens are dropped by the token supply mechanism 17 at the token station 37 into equally spaced cylindrical apertures 35 formed in the turret 29. Each time it is indexed, the turret 29 rotates in a clockwise direction (as viewed in FIG. 1) and moves a blank token 12 to the engraving station 39. At the engraving station characters are engraved into the peripheral upper surface of the tokens. When character engraving is completed, the turret is indexed and the engraved token is moved to the ejection station 41 whereat the ejection mechanism 27 ejects the engraved token.

TURRET MECHANISM

The turret mechanism includes a plurality of cylindrical spacers 43 (FIG. 4) which support a backing plate 45 a fixed distance above the mounting plate 11. The backing plate 45 is held fixed in place by bolts 44 that pass through the cylindrical spacers 43. The backing plate is located such that it lies beneath, and supports, the turret 29 in the regions where tokens are held by the turret for movement between stations; i.e., arcuately from beneath the token mechanism 17 to beneath the engraving station 39—up to the near edge of the ejection station 41. The upper surface of the backing plate is designed to be friction free whereby the turret is free to slide over this surface. As necessary, additional turret support mechanisms (not shown), mounted beneath the turret between the ejection station and the supply station, about the lower portion of the turret path as illustrated in FIG. 1, may be provided. The only restriction on such additional turret support mechanisms is that they must be positioned such that they do not hamper operation of the turret indexing mechanism 19.

Two or more hold-down plates 47 are spaced about the periphery of the turret. The hold-down plates extend a slight distance over the upper surface of the turret and, thus, prevent the turret from rising. The hold-down plates 47 are attached to and spaced from the mounting plate 11 by suitable bolt spacer combinations 49. The turret 29 is maintained in its lateral position by a plurality of turret guides 51 also spaced about the periphery of the turret 29. The turret guides 51, as illustrated in FIG. 4, comprise bolts 54 that pass downwardly through cylindrical rollers 56 and spacers 52 into the mounting plate 11. The rollers 56 impinge on the peripheral edge of the turret 29. In this manner, the turret 29 is supported and maintained in a horizontal plane in a manner such that it is free to be rotated, as hereinafter described.

TOKEN SUPPLY MECHANISM

The token supply mechanism 17 comprises a plurality of cylindrical tubes 53 supported so that their axes are vertical by a Z-shaped support bracket 55, and a flat upper support bracket 57. The Z-shaped support bracket is attached by a plurality of bolts 59 to the mounting plate 11. The cylindrical tubes are supported in apertures in the Z-shaped support bracket 55 and the flat upper support bracket 57 in a manner such that the tubes lie over sequential apertures in the turret when the turret is at rest. Thus, the cylindrical tubes each hold a stack of blank cylindrical tokens 12 above the turret 29. Blank tokens mean non-character engraved tokens. However, they may have previously engraved (or otherwise created) configurations on one or both surfaces, such as a picture of a historical monument, for example. It should be noted here that the thickness of the turret is equal to the thickness of the tokens. As the turret rotates in a clockwise direction, as viewed in FIG. 1, it first empties the first cylindrical tube 53 it meets in its direction of travel. Thereafter, the next, and then the next, cylindrical tubes are emptied. While three cylindrical tubes are illustrated in FIG. 1, it will be appreciated that two or even one such tube only need be included, if desired. Moreover, more than three can be included, if desired.

PRINT MECHANISM

The print mechanism 15 comprises a type head 61 that includes a plurality of radially extending type bars 63. The type head 61 is located inside of the turret and includes a cylindrical cap 65 attached by bolts 67 to a cylindrical housing 69. The cylindrical housing 69 is cup shaped and has its outer rim cut into a plurality of segments 71. The type bars 63 extend outwardly between the segments 71 and inwardly toward a boss 70, located in the center of the cylindrical housing 69. The inner ends of the type bars 63 are spaced from the boss 70 and are connected together by a ring 72 that passes through inverted U-shaped apertures 74 formed in the underside of the inner ends of the type bars. The cylindrical cap 65 is attached to the boss 70 of the cylindrical housing 69 by the bolts 67 and extends outwardly so as to lie above the upper inner ends of the type bars 63. A plurality of coil springs 77 are mounted in apertures located just inside of the rim of the cylindrical housing 69. The coil springs are mounted and arrayed in a manner such that one spring presses against each type bar 63. Thus, the springs rotate the type bars upwardly about the ring 72. The cylindrical cap 65 controls the amount of such rotation and, thus, the normal inclination angle of the type bars. When a type bar 63 is positioned to engrave a character in a token, as hereinafter described, it is rotated downwardly against the pressure of its associated coil spring 77, as illustrated on the right side of FIG. 4.

The outer periphery of the cylindrical housing 69 is toothed, i.e., includes a plurality of teeth 79 located along its lower edge. The teeth are equal in number to the number of type bars and allow the housing 69, and thus the type bars, to be locked in place during engraving, as hereinafter described.

Mounted in a cylindrical aperture 80, and extending upwardly from the type head 61, is a vertical shaft 81. Any suitable attachment means, such as a key 83 mounted in aligned notches formed in the vertical shaft 81 and a boss 82 formed in the upper surface of the cylindrical cap 65, can be utilized to attach the vertical shaft 81 to the type head 61. The longitudinal axis of the vertical shaft is coaxial with the central axis of the cylindrical housing 69. The lower end of the vertical shaft 81, as viewed in FIG. 4, extends through the cylindrical housing 69 into a cylindrical support 84 affixed to the mounting plate 11 by a plurality of bolts 85. The cylindrical support 84 is cup shaped and surrounds the teeth 79 of the cylindrical housing 69. The cylindrical support includes an upper boss 87 and a lower boss 88 through which the vertical shaft 81 passes. A bushing 89 lies between the cylindrical support 84 and the vertical shaft 81. The bushing includes a flange that lies between the cylindrical housing 69 and the cylindrical support 84.

The vertical shaft 81 is affixed, at its upper end, to an angular outwardly extending shaft 89 by a suitable coupling 90, such as a universal joint (illustrated) or a bevel gear arrangement (not illustrated). The angular outwardly extending shaft supports a pointer arm (not illustrated) that co-acts with a fixed display (also not illustrated) to control the position of the type head 61, and provide an indication of such position. More specifically, as the angular outwardly extending shaft 89 is rotated, its rotational movement is transferred by the coupling 90 to the vertical shaft 81, and the type head is rotated. An arm mounted on the outer end of the angular outwardly extending shaft 89 is used to control such movement, plus act as a pointer. The pointer coacts with a display. In this manner, the position of a particular character type bar with respect to a particular point (the engraving station 39) is readily identified.

It should be noted at this point that the axis of rotation of the type head 61 is offset with respect to the axis of rotation of the turret 29 toward the engraving station 39. Thus, the outer edges of the type bars 63, which include character type on their lower outer tips, can be rotated over tokens located at the engraving station 39 without passing over the turret 29 at the token supply station 37. It should also be noted, however, that the type head could be located in other positions, such as outside of the turret, for example.

PRESS

Figures 3, 5:
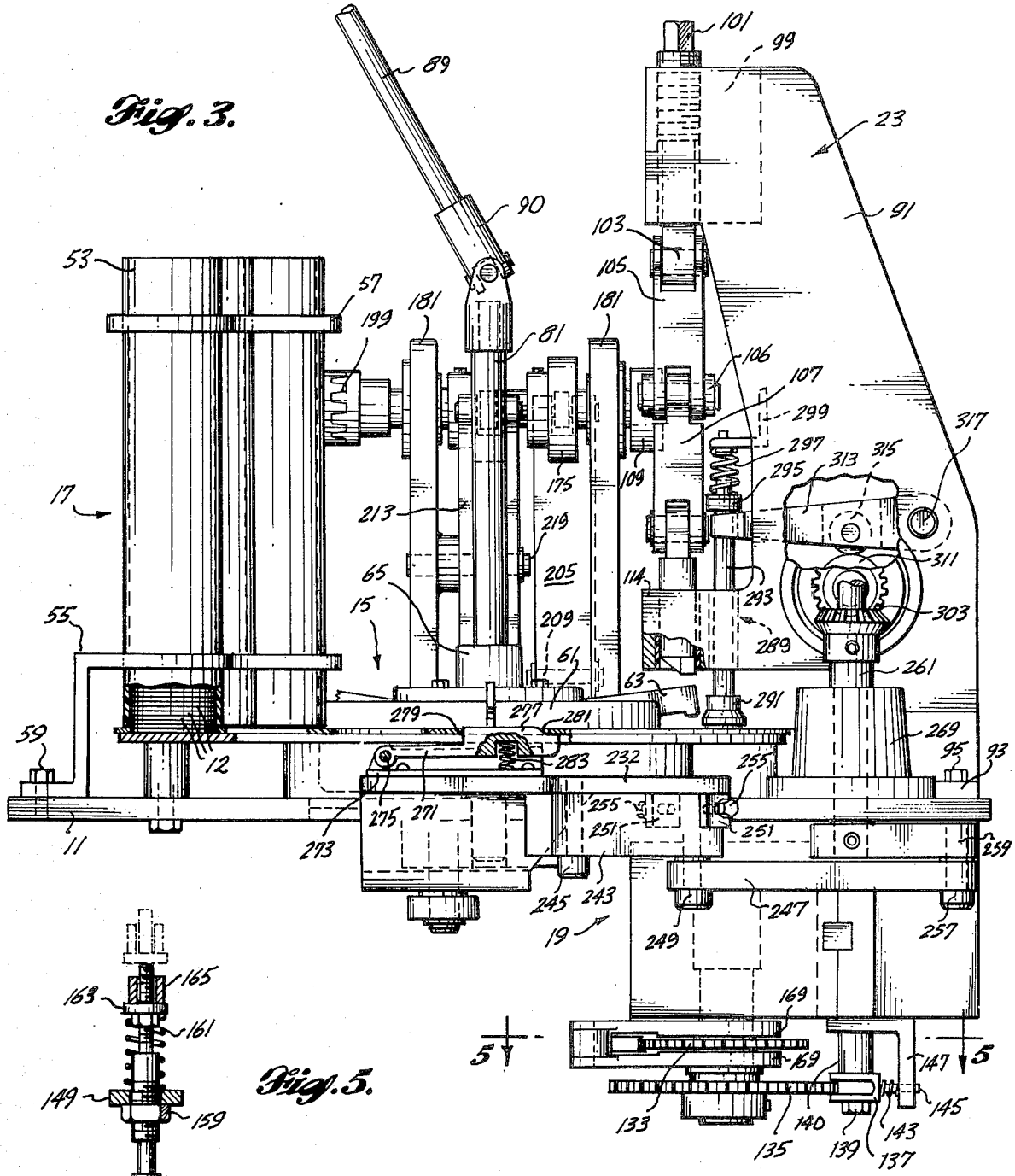
FIG. 3 is an end view of the embodiment of the invention illustrated in FIG. 1.
FIG. 5 is a cross-sectional view along line 5-5 of FIG. 3.

The press 23 can take on a variety of forms—a knuckle press being illustrated. The illustrated press 23 comprises a paair of parallel support plates 91 which project vertically upwardly from the mounting plate 11 and are affixed thereto by support plate flanges 93 and bolts 95. The press support plates 91 project upwardly and inwardly, as illustrated in FIG. 3, so as to provide a head support region which lies directly above the engraving station 39. An upper support block 99 is mounted between the press support plates and forms the head. A vertically oriented press pressure adjustment bolt 101 is threaded into the upper support block 99. The press pressure adjustment bolt 101 is adapted to move a lower block 103 upwardly and downwardly as it is rotated, without rotating the lower block. Rotatably attached to the lower block 103 is one end of an upper press arm 105. Rotatably attached to the other end of the upper press arm 105 is one end of a lower press arm 107. Rotatably attached to the junction between the upper and lower press arms 105 and 107 is one end of a driving arm 109. Attached to the other end of the lower press arm 107 is a plunger 111. As illustrated in FIG. 4, the plunger 111 is vertically mounted in a bushing 110 held in a lower support block 112. The lower support block is mounted between arms 114 forming a part of the press support plates 91. The plunger 111 is, thus, adapted to be moved vertically downwardly and upwardly. When moved downwardly, the plunger 111 presses the outer end of the type bar 63, located beneath the plunger 111 and above a token located at the engraving station 39, into the token. In this manner, the character type associated with the type bar is pressed into the token and creates an engraved character. Downward movement of the plunger 111 and an engraving force occur when the driving arm 109 is moved to the left, as illustrated in FIG. 6 by the arrow 116. Pressure applied by the press to the type bars is controlled by the press pressure adjustment bolt 101.

As can be seen best in FIG. 4, the outer tip of the type bar 63 whose character type is desired is located above the leftmost peripheral upper edge of the cylindrical token 12 located at the engraving station 39. Thus, when the plunger 111 moves downwardly, the character type is pressed into this token and engraves a character in the upper peripheral surface thereof. Engraving can take either of two forms—depressed characters or raised characters, as desired, depressed characters being preferred. Subsequent to a single character engraving operation, the token located at the engraving station is indexed a predetermined distance about its central axis. Thereafter, the outwardly extending shaft 89 is rotated until a type bar having the next desired character type is positioned above the token located at the engraving station. Thereafter, that character is engraved and the token is again indexed. In this manner a desired sequence of characters are engraved into the upper peripheral surface of the token 12.

TOKEN INDEXING MECHANISM

The token indexing mechanism 25 comprises a replaceable anvil 113 supported beneath the engraving station 39 by a tubular support 115. The anvil 113 is T-shaped in cross-section and includes a downwardly projecting leg 117 which lies within a vertical cylindrical aperture formed in the upper end of the tubular support 115. Preferably, the upper surface of the anvil is covered by a layer 116 formed of a high friction material, such as a layer of polyurethane, for example. As illustrated in FIG. 2, the mid-region of the tubular support 115 lies in a tubular housing 123. The tubular housing 123 is affixed to any suitable support, such as the mounting plate 11 by means not illustrated. An upper bearing 125 is affixed to the upper end of the tubular housing 123. The mid-region of the tubular support 115 passes through the bearing and includes a flange 121 that impinges on the upper surface of the upper bearing to prevent downward movement of the tubular support (and, thus, the anvil) during engraving.

A lower bearing 127 is affixed to the lower end of the tubular housing 123. The mid-region 119 of the tubular support 115 terminates at the top of the lower bearing 127. Passing through the bearing and extending downwardly therefrom is a lower cylindrcal region 129 forming part of the tubular support 115. It will be appreciated that the upper and lower bearings mount the tubular support and, thus, the anvil 113 in a manner such that the anvil can be rotated with respect to the fixed tubular housing 123.

The lower cylindrical region 129 of the tubular support 115 passes through an aperture 131 formed in the lower end of the tubular housing 123. Mounted on the downwardly projecting lower cylindrical region 129 are the ratchet wheel 133 and the sprocket wheel 135 of a ratchet assembly 132. The ratchet assembly 132 is best illustrated in FIGS. 2 and 5 and controls token indexing. The sprocket wheel 135 coacts with a locking pawl 137 to lock the tubular support against reverse movement when the driving pawl 171 returns to its initial position, as hereinafter described.

The locking pawl 137 is rotatably mounted on a bolt 139, beneath a cylindrical spacer 140. The bolt terminates at an L-shaped support 147. The locking pawl 137 includes a tooth 141 lying in the plane of the sprocket wheel 135. On the side of the locking pawl opposite to the tooth 141 is a coil spring 143. The coil spring 143 is mounted about a pin 145 affixed to the L-shaped support 147. The arrangement is such that the coil spring presses the tooth 141 of the pawl against the periphery of the sprocket wheel 135.

The token indexing mechanism 25 further comprises a downwardly extending support bracket 149 (FIG. 2) which is generally T-shaped in cross-section whereby it includes flanges 151. The flanges 151 are attached to the mounting plate 11 by bolts 153. The downwardly extending support bracket 149 includes an aperture through which a horizontal shaft 155, having an axis that is essentially coplanar with the plane defined by the ratchet wheel 133, passes. The horizontal shaft 155 includes a threaded mid-region 157 which supports an adjustment nut 159 located on the side of the support bracket 149 nearest the ratchet wheel 133. Located on the other side of the bracket 149 about the horizontal shaft 155 is a coil spring 161. The coil spring presses a locking nut 163, located near its outer end, against the lower tip 165 of a token indexing cam follower 167 operated by the engraving control mechanism 21 in the manner hereinafter described. Preferably, the lower tip 165 is in the form of a yoke having legs lying on either side of the outer tip of the horizontal shaft 155.

Bushings 170 are mounted on the lower cylindrical region 129 of the tubular support 115 on either side of the ratchet wheel 133. A yoke 169 is mounted on the bushings 170 and houses the driving pawl 171. The yoke is rotatably attached to the inner end of the horizontal shaft 155 and generally projects outwardly therefrom at right angles. The driving pawl is spring loaded with respect to the yoke 169. Specifically, the driving pawl 171 is rotated against the saw toothed apertures in the ratchet wheel 133 by a coil spring 173 having outwardly extending arms.

It will be appreciated from the foregoing description, and from viewing FIGS. 2 and 5, that as the token indexing cam follower 167 is moved back and forth between its solid to its dotted line positions, the driving pawl 171 sequentially interacts with the teeth of the ratchet wheel 133. Each time this action occurs, the tubular support 115 and the anvil 113 are indexed (moved) a predetermined angular amount. The locking pawl 137, due to its interaction with the sprocket wheel 135, locks the tubular support in position, when the driving pawl 171 returns to its start position (the dotted line position illustrated in FIGS. 2 and 5). Because a single tooth of the ratchet wheel is indexed, equal angular indexing of the anvil, and the token supported by it, occurs for each token indexing cycle of operation.

ENGRAVING CONTROL MECHANISM

The engraving control mechanism 21 controls three functions: (1) locking the print mechanism 15 in place during an engraving operation; (2) moving arm 109 in a manner such that arms 105 and 107 of the press become vertically oriented to move the plunger 111 downwardly and cause an engraving operation; and (3) moving the token indexing cam follower 167 to cause a token indexing operation in the manner described above.

The engraving control mechanism comprises: a first electric motor 172; a type head locking cam 174; a token indexing cam 175; and an eccentric 177. The type head locking cam 174, the token indexing cam 175 and the eccentric 177 are all mounted on a common horizontal shaft 179. The common shaft 179 is rotatably journaled in a pair of vertical brackets 181 affixed to the mounting plate 11 by flanges 185 and bolts 189. The first electric motor 172 is mounted by a mounting bracket 193 in a manner such that the shaft of the motor is coaxial with the common horizontal shaft 179. The motor mounting bracket 193 is also affixed to the deck 111 by a flange 195 and bolts 197. The shaft of the first electric motor 172 is coupled by a suitable coupling mechanism 199 to the common horizontal shaft 179. The coupling mechanism 199 is a divided releasing coupling mechanism whereby the motor can be easily disengaged from the common shaft 179 for repair and replacement purposes.

The first electric motor 172 is a single revolution motor well known to those skilled in the art. Specifically, when the motor 172 is energized by the closure of a momentary contact switch, its shaft starts to rotate. A further shaft operated switch is closed when the shaft starts to rotate and maintains power to the motor. At the end of a single revolution, the shaft operated switch opens and motor shaft rotation stops. A second closure of the momentary contact switch causes the motor to be re-energized and its shaft to go through a second revolution. Thus, each time the motor is energized via a suitable momentary contact switch (not shown) the common horizontal shaft 179 is rotated through 360° (one revolution).

The eccentric 177 is located on the end of the common shaft remote from the motor end, beyond the shaft support bracket 181. A bolt 201 or other suitable mechanism attaches the other end of the press driving arm 109 in a rotatable manner to a point on the eccentric that is spaced from its axis of rotation as defined by the longitudinal axis of the common shaft 179. Thus, rotation of the common shaft 179 causes the press driving arm 109 to move first in the direction of the arrow 116 illustrated in FIG. 2, and then in the opposite direction as it returns to its initial position. This cycle of operation occurs once each time the shaft 179 makes a single revolution. The press driving arm motion is transferred, via the lower press arm 107 to the plunger, causing the plunger 111 to move down, and then up, once each cycle also. As previously explained this movement of the plunger causes a character to be engraved into a token located at the engraving station 39.

The token indexing cam follower 167 comprises two sections—a downwardly extending part 203 and an outwardly and upwardly extending, generally C-shaped part 205. As previously stated, the lower tip 165 of the downwardly extending part 203 is in the form of a yoke in which the outer tip of the horizontal shaft 155 lies. A roller 207 is rotatably affixed to the upper end of the C-shaped part and rides on the peripheral surface of the token indexing cam 175. The junction between the downwardly extending part 203 and the outwardly and upwardly extending, generally C-shaped, part 205 is the pivot point of the token indexing cam follower. A horizontal pin 209 passes through the pivot point and the adjacent vertical bracket 181, as illustrated in FIG. 3.

The token indexing cam 175, as illustrated in FIG. 2, has a single sharp lobe 211. Thus, each time the common horizontal shaft rotates through a single revolution the token indexing cam 175 causes the token indexing cam follower 167 to move once inwardly and outwardly between its solid and dashed line positions illustrated in FIG. 2. As previously explained such movement of the token indexing cam follower causes the token supported on the anvil at the engraving station to be indexed a predetermined arcuate amount.

A roller 211 rotatably mounted on a locking cam follower 213 rides on the locking cam 174. The locking cam follower 213 comprises two sections—a C-shaped section 215 and a downwardly extending section 217. The junction between the two sections defines a pivot point. A horizontal pin 219 passes through this pivot point and the adjacent vertical bracket 181. The C-shaped section curves inwardly, as opposed to outwardly, with respect to the other main mechanisms of the invention. The roller 221 is mounted on the upper end of the C-shaped section of the locking cam follower. In the illustrated embodiment of the invention, the locking cam 174 is a slow rise, fast fall single lobe cam. The lower tip of the downwardly extending section 217 of the locking cam follower is yoke shaped and impinges on a washer 223. The washer 223 is mounted on a horizontal shaft and impinges on an adjustment nut 225 screwed onto the same shaft. The adjustment nut impinges on one end of a coil spring 227 also mounted on the shaft 224. The other end of the coil spring impinges on a bracket 229 mounted near the edge of the mounting plate 11. The outer tip of the horizontal shaft 224 is slidably mounted in the bracket 229. The coil spring pivots the locking cam follower 213 about the pin 219 forcing the roller 221 against the peripheral surface of the locking cam 173. Thus, as the locking cam revolves, the horizontal shaft 224 reciprocates back and forth. The inner tip of the horizontal shaft 224 is chisel-shaped and forms a locking pawl 231. The chisel-shaped inner tip is adapted to fit into one of the teeth 79 formed in the lower peripheral surface of cylindrical housing 69 of the type head 61 when the horizontal shaft 224 moves a sufficient distance to the left, as viewed in FIG. 2. In this manner the locking pawl 231 locks the type head in position during an engraving operation.

It will be appreciated from the foregoing description that the engraving control mechanism 121 controls all of the engraving actions. More specifically, when the first motor 172 is energized, three actions occur: (1) the locking pawl 231 is moved into a tooth 79 formed in the cylindrical housing 69 to lock the type head 61 in place; (2) the press driving arm 109 is moved to the left as illustrated in FIG. 2 to cause an engraving operation; and, (3) as the plunger 111 is being raised subsequent to engraving, the token is indexed. Subsequent to this sequence, the type head is manually rotated until the type bar 63 containing type related to the next character to be engraved is aligned with the engraving station. Thereafter, the first motor 172 is again energized and the sequence is repeated. It will be appreciated that because the type head 61 is locked during engraving, movement of the type head which could distort the character, is prevented. Moreover, because the token is indexed an equal amount during each sequence of operation, the engraved characters are equally spaced around the periphery of the token.

TURRET INDEXING MECHANISM

The turret indexing mechanism 19 comprises a somewhat Z-shaped arm 232 which extends outwardly and upwardly from beneath the cylindrical support 84 for the type head 61. Specifically, as illustrated in FIG. 4, the lower, inner end of the Z-shaped arm 232 is rotatably mounted on a vertical shaft 233. The vertical shaft is affixed to the cylindrical support 84 by a pin 235. Vertical movement of the Z-shaped arm 232 is prevented by a washer 237 and a retaining ring 239 mounted on the vertical shaft 233, beneath the Z-shaped arm 232. A bushing 241 is located between the Z-shaped arm 232 and the vertical shaft 233.

Rotatably attached beneath the outer end of the Z-shaped arm 232 is an adjustment link 243. More specifically, one end of the adjustment link 243 is rotatably attached to the Z-shaped arm 232 by a suitable bolt 245. The other end of the adjustment link 243 is rotatably connected to a connecting link 247 by a bolt 249. Located on either side of the adjustment link 243, adjacent the point of connnection to the connecting link, and projecting downwardly from the Z-shaped arm 232, are a pair of ears 251. Threaded through the ears are a pair of adjustment bolts 255. The bolts are movable inwardly and outwardly with respect to the ears 251 and press against either side of the adjacent end of the adjustment link 243. Thus, the adjustment bolts control the position of the adjustment link 243 with respect to the Z-shaped arm 232. As will be better understood from the following description of the remainder of the turret indexing mechanism, adjusting the position of the adjustment link with respect to the Z-shaped arm controls the indexed positions of the turret.

The other end of the connecting link 247 is rotatably connected by bolt 257 to one end of a crank arm 259. The other end of the crank arm 259 is affixed to the lower end of a vertical drive shaft 261. The vertical drive shaft 261, as illustrated in FIG. 2, is attached to the shaft of a second electric motor 263 by a suitable coupling mechanism 265. The second electric motor is also a single revolution electric motor i.e., subsequent to the closure of a momentary contact switch (not shown), its shaft goes through a single revolution. A suitable support bracket 267 supports the second electric motor 263 such that its shaft is coaxial with the vertical drive shaft 261. A suitable shaft support cone 269 is affixed to and projects upwardly from the mounting plate 11 to provide support for the vertical drive shaft 261. A suitable bushing or bearing (not shown) is housed in the support cone 269 to allow the vertical drive shaft 261 to rotate with respect thereto.

Located on the upper surface of the Z-shaped arm 232 is a spring loaded indexing arm 271. The indexing arm 271 has one end rotatably attached to an attachment bracket 273 by a horizontal pin 275. More specifically, the attachment bracket 273 is affixed to the Z-shaped arm 232. Located at one end of the attachment bracket 273 is an upwardly extending flange (or flanges) which supports the horizontal pin 275.

The other end of the indexing arm 271 includes, as best illustrated in FIG. 3, an upwardly projecting region 277. The upwardly projecting region, has a sharp semicircular front edge 279 and a beveled semicircular rear edge 281. The sharp semicircular front edge, as best illustrated in FIG. 1, is adapted to impinge on the leading edge of a token aperture 35 during turret indexing. Contrawise, the beveled semicircular rear edge is adapted to impinge on, and slide under, the turret during the return stroke of the indexing arm. A coil spring 283 lies in an aperture beneath the upwardly projecting region 277 and presses the indexing arm 271 upwardly against the turret 29. The lower end of the coil spring 283 presses against the attachment bracket 273.

In operation, as set forth above, when the second electric motor 263 is energized, its shaft rotates through 360° and, then, stops. When the shaft of the second electric motor starts to rotate, crank arm 259 starts to move causing connecting link 247 to move the Z-shaped arm 232 via the adjustment link 243. The movement is such that the sharp semicircular front edge of the upwardly projecting region impinges on the leading edge of an aperture in the turret located above the turret indexing mechanism. This impingement causes the turret to move in a clockwise direction as viewed in FIG. 1. When the second motor has rotated the crank arm through a 180° arc, the Z-shaped arm 232 has moved its maximum distance and starts to return. At this point, each aperture in the turret has been moved (indexed) one position. As the Z-shaped arm returns to its initial position, the beveled semicircular rear edge 281 impinges on the trailing edge of the same aperture the sharp front edge previously impinged on. However, because the rear edge 281 is beveled, the indexing arm rotates downwardly about horizontal pin 275 against the force created by the coil spring 283. When the mechanism returns to its initial position, the indexing arm 271 has its upwardly projecting region 277 forced into the "next" aperture 35 by the coil spring 283. At this point, the energization of the second electric motor terminates. A subsequent energization of the second electric motor 263 causes a repeat of the cycle of operation. In this manner, the turret is indexed one position each time the second electrical motor is energized. It should be noted that this description has described the operation of the turret indexing mechanism such that starting and stopping occurs exactly when the upwardly projecting region 277 is located in an aperture 35. However, as will be appreciated by those skilled in the art, any other position can be chosen for starting and stopping, the only requirements being that the position be compatible with the other mechanism of the invention, and the same for each cycle of operation.

TOKEN HOLD DOWN MECHANISM

The second electric motor 263 also controls a token hold down mechanism 289, including a token hold down foot 291 mounted above the engraving station. The token hold down foot 291 applies pressure against the upper surface of the token located at the engraving station 39 without preventing the rotation thereof during token indexing. Preferably, a layer of high friction material is attached to the lower surface of the token hold down foot. Because such pressure is applied, accurate indexing, which would not readily occur if such pressure were not applied and the token was allowed to float, is provided.

The token hold down foot 291 is located at the lower end of a vertically oriented token hold down shaft 293. The token hold down foot 291 may be rotatable with respect to the token hold down shaft 293 even though, preferably, the shaft is rotated when the foot is rotated. In any event, the upper end of the token hold down shaft is threaded and supports a nut 295 (FIG. 3). The upper tip of the token hold down shaft 293, above the nut 295, lies inside of a vertical coil spring 297. The upper end of the vertical coil spring 297 presses against a face of an L-shaped bracket 299 fixedly mounted between the press support plates 91. In this manner, the token hold down foot 291 is normally pressed downwardly against the upper surface of the token located at the engraving station.

A power take-off shaft 301 is driven, via a beveled gear arrangement 303, by the vertical drive shaft 261. The power take-off shaft 301 is held horizontal by a housing 305 affixed to and projecting outwardly from the press support plate 91 nearest the vertical drive shaft 261. The outer end of the housing 305 supports a bearing 307 through which the power take-off shaft 301 passes. The power take-off shaft 301 passes through both press support plates 91. A second bearing 309, through which the power take-off shaft passes, supports it in the remote press support plate.

Affixed to the power take-off shaft 301, intermediate the press support plates 91, is a single, sharp lobe, cam 311 (FIG. 3). Mounted above the cam 311 is a cam follower arm 313. The cam follower arm 313 includes a rotatable cam follower element 315 that rides on the cam 311. One end of the cam follower arm 313 is rotatably mounted on a shaft 317 mounted between the press support plates 91, above and outwardly from the power take-off shaft 301. The other end of the cam follower arm 313 includes a pair of arms 319 which lie on either side of the token hold down foot shaft 293, beneath the nut 295.

In operation, as the second electrical motor 263 rotates the vertical drive shaft 261, the power take-off shaft 301 rotates. As the power take-off shaft rotates, the lobe of the cam 311 reaches a point where it impinges on the rotatable cam follower element 315. When this action occurs, the cam arm 313 is rotated upwardly about shaft 317. This action moves the token hold down foot 291 upwardly, via the token hold down foot shaft 293. Thus, impingement between the token hold down foot 291 and the token is terminated. As this action occurs, the turret 29 is being indexed, in the manner previously described, and the engraved token is moved from the engraving station 39 to the ejection station 41 whereat it is ejected.

EJECTION MECHANISM

The ejection mechanism 27 comprises a generally U-shaped spring 321. The U-shaped spring 321 is fixed at one end by a bolt 323 to the mounting plate 11. The other end of the ejection spring 321 supports an impingement element 325 which is pressed downwardly by the U-shaped spring against tokens, located in apertures 35 in the turret, as the turret moves them into the ejection station 41. In this manner, tokens are pressed from their associated apertures at the ejection station and drop vertically. The dropping tokens are collected by an ejection tube 327 which delivers them to a suitable receptacle.

It will be appreciated from the foregoing description that the invention comprises a token engraving mechanism which is electromechanical in nature. That is, a first electric motor controls engraving in a manner such that equally spaced and equally indented characters are engraved about the periphery of one surface of a token. A second electric motor controls holding down of the token during engraving and rotation of an essentially jam proof turret. The turret moves between a token supply station, an engraving station and an ejection station. The only manual operative mechanism of the invention is the movement of type bars to locations above the engraving station. Because equal pressure is applied during each engraving operation, the characters are equally engraved in depth and size. Moreover, because an accurate indexing mechanism is provided, the characters are equally spaced. Further, the overall apparatus is accurately adjustable via the various adjustment mechanisms described.

While a preferred embodiment of the invention has been illustrated and described, it will be appreciated by those skilled in the art and others that various changes can be made therein without departing from the spirit and scope of the invention. For example, other types of press mechanisms can be utilized. Further, other types of typing mechanisms, other than that specifically illustrated, can be utilized, if desired. Moreover, the token supply mechanism can operate in a different fashion. For example, the token supply tubes could be mounted on a turret mechanism and sequentially moved over the apertures in the turret. Hence, the invention can be practiced otherwise than as specifically described herein.

The embodiments of the invention in which an exclusive property or privilege is claimed are defined as follows:

What is claimed is:

1. A token engraving apparatus for selectively engraving a sequence of characters onto the surface of a token, said token engraving apparatus comprising:

a multiple apertured turret mechanism suitable for supporting a plurality of tokens in a plurality of apertures and moving said plurality of tokens sequentially along a generally horizontal path of travel through a token supply station, a token engraving station and a token ejecting station, said multiple apertured turret mechanism comprising a flat, ring-shaped plate movable about a turret axis centrally located with respect to said flat ring-shaped plate;

a token supply mechanism located at said token supply station for supplying tokens downwardly, under the force of gravity, such that said tokens fall sequentially into said plurality of apertures in said multiple apertured turret mechanism;

a printing mechanism suitable for selectively positioning character type at said engraving station in a manner such that said character type can be pressed into a surface of tokens located at said engraving station in a sequential manner so as to engrave a selective sequence of characters therein, said printing mechanism comprising a printing head having a generally circular outer periphery and suitable for rotation about a print axis, said character type being located about the outer periphery of said print head and said print axis being located inside of said ring-shaped plate forming said multiple apertured turret mechanism, but offset with respect to said turret axis, said print head being rotatable independently of movement of said multiple apertured turret mechanism;

a locking mechanism suitable for locking said print head in position during the period of time that a character type is being pressed into a surface of a token located at said engraving station;

an engraving mechanism located at said token engraving station for pressing type brought to said station by said print head into engraving contact with a surface of a token located at said engraving station;

token indexing mechanism lcoated at said engraving station for indexing a token located at said engraving station subsequent to a character being engraved therein;

an ejection mechanism located at said ejection station for ejecting tokens downwardly from said ring-shaped plate forming said multiple apertured turret mechanism subsequent to said tokens being engraved at said engraving station;

electromechanical indexing means mechanically connected to said ring-shaped plate for indexing said ring-shaped plate a predetermined amount each time said electromechanical indexing means is energized; and, electromechanical control means connected to said engraving mechanism for controlling the operation of said engraving mechanism including the operation of said locking mechanism and the operation of said token indexing mechanism.

2. A token engraving apparatus as claimed in claim 1, wherein said engraving mechanism comprises a press mounted so as to move the character type of said print mechanism into engraving contact with a token located at said engraving station.

3. A token engraving apparatus as claimed in claim 2, wherein the character type of said print mechanism is positioned above the peripheral upper surface of a token located at said token engraving station prior to bringing the character type into engraving contact with the token.

4. A token engraving apparatus as claimed in claim 3, wherein said print mechanism comprises a type head including a plurality of type bars which extend radially outwardly from a central axis of rotation, the lower peripheral edge of each of said type bars including character type.

5. A token engraving apparatus as claimed in claim 4, wherein said token indexing mechanism comprises an anvil located beneath said engraving station for supporting a token located at said engraving station during engraving of a character therein, the upper surface of said anvil being covered with a suitable high friction material.

6. A token engraving apparatus as claimed in claim 5, wherein said high friction material is polyurethane.

7. A token engraving apparatus as claimed in claim 6, wherein said press is a knuckle press.

8. A token engraving apparatus as claimed in claim 7 including a token hold-down foot located above said engraving station and adapted to press a token located at said engraving station against said anvil, said token hold-down foot being operatively connected to said electromechanical indexing means so as to be raised when said turret is indexed.

9. A token engraving apparatus as claimed in claim 8, wherein said locking mechanism for locking said print mechanism comprises a pawl operatively connected to said electromechanical control means and a plurality of teeth located about the periphery of said type head, one of said teeth being associated with each of said type bars, said pawl being movable into an associated tooth when a desired type bar is located above a token at said engraving station and is being brought into engraving contact with said token.

10. A token engraving apparatus as claimed in claim 9, wherein said indexing mechanism for indexing tokens at said engraving station comprises a pawl and ratchet mechanism operatively connected to said anvil, said electromechanical control means connected to said pawl and ratchet mechanism for controlling the operation of said pawl and ratchet mechanism in a manner such that said anvil is rotated the same arcuate amount subsequent to each character being engraved into a token supported by said anvil.

11. A token engraving apparatus as claimed in claim 10, wherein said electromechanical control means comprises:

a single revolution electric motor;

a locking cam coupled to the shaft of said single revolution electric motor;

a locking cam follower mounted so as to ride on said locking cam and operatively connected to said locking pawl;

a token indexing cam coupled to the shaft of said single revolution electric motor;

a token indexing cam follower mounted so as to ride on said token indexing cam and operatively connected to said pawl and ratchet mechanism; and, an eccentric coupled to the shaft of said single revolution electric motor and operatively connected to said knuckle press.

12. A token engraving apparatus as claimed in claim 1, wherein said token indexing mechanism comprises an anvil located beneath said engraving station for supporting a token located at said engraving station during engraving of a character therein, the upper surface of said anvil being covered with a suitable high friction material.

13. A token engraving apparatus as claimed in claim 12, wherein said high friction material is polyurethane.

14. A token engraving apparatus as claimed in claim 13 including a token hold-down foot located above said engraving station and adapted to press a token located at said engraving station against said anvil, said token hold-down foot being operatively connected to said electromechanical indexing means so as to be raised when said turret is indexed.

15. A token engraving apparatus as claimed in claim 13, wherein said print mechanism comprises a type head including a plurality of type bars which extend radially outwardly from a central axis of rotation, the lower peripheral edge of each of said type bars including character type.

16. A token engraving apparatus as claimed in claim 15, wherein said locking mechanism for locking said print mechanism comprises a pawl operatively connected to said electromechanical control means and a plurality of teeth located about the periphery of said type head, one of said teeth being associated with each of said type bars, said pawl being movable into an associated tooth when a desired type bar is located above a token at said engraving station and is being brought into engraving contact with said token.

17. A token engraving apparatus as claimed in claim 1, wherein the character type of said print mechanism is positioned above the peripheral upper surface of a token located at said token engraving station prior to bringing the character type into engraving contact with the token.

* * * * *